US008077115B2

(12) United States Patent
Yamada et al.

(10) Patent No.: US 8,077,115 B2
(45) Date of Patent: Dec. 13, 2011

(54) ANTENNA DEVICE, RADIO TAG READER AND ARTICLE MANAGEMENT SYSTEM

(75) Inventors: Akiko Yamada, Yokohama (JP); Shuichi Sekine, Hachioji (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 391 days.

(21) Appl. No.: 12/233,923

(22) Filed: Sep. 19, 2008

(65) Prior Publication Data

US 2009/0121964 A1 May 14, 2009

(30) Foreign Application Priority Data

Nov. 9, 2007 (JP) ..... 2007-292121

(51) Int. Cl.
*H01Q 7/00* (2006.01)

(52) U.S. Cl. ..... 343/895; 343/866; 343/795

(58) Field of Classification Search ..... 343/866, 343/795, 895

See application file for complete search history.

(56) References Cited

U.S. PATENT DOCUMENTS 5,793,336 A * 8/1998 Shoemaker et al. ..... 343/795
2005/0088344 A1* 4/2005 Saitou et al. ..... 343/700 MS
2005/0162331 A1* 7/2005 Endo et al. ..... 343/788
2005/0212707 A1* 9/2005 Egbert et al. ..... 343/702
2007/0262903 A1 11/2007 Yamada et al.

FOREIGN PATENT DOCUMENTS

JP 2003-51707 2/2003
JP 2005-167416 6/2005
JP 2006-86739 3/2006

* cited by examiner

*Primary Examiner* — Douglas W Owens
*Assistant Examiner* — Dieu H Duong
(74) *Attorney, Agent, or Firm* — Oblon, Spivak, McClelland, Maier & Neustadt, L.L.P.

(57) ABSTRACT

There is provided with an antenna device includes; a first antenna element which is either a spiral antenna element or a loop-like antenna element; and a first feed point provided at a first end of the first antenna element, the first end being an outer end of the spiral antenna element or an one end of the loop-like antenna element, wherein a length from an second end of the first antenna element to the first end of the first antenna element along the first antenna element is about one half wavelength of operating frequency, the second end being an inner end of the spiral antenna element or the other end of the loop-like antenna element.

6 Claims, 15 Drawing Sheets

(A) PERSPECTIVE VIEW (FRONT)

(B) PERSPECTIVE VIEW (REAR)

ANTENNA DEVICE, RADIO TAG READER AND ARTICLE MANAGEMENT SYSTEM

CROSS REFERENCE TO RELATED APPLICATIONS

This application is based upon and claims the benefit of priority from the prior Japanese Patent Applications No. 2007-292121, filed on Nov. 9, 2007; the entire contents of which are incorporated herein by reference.

BACKGROUND OF THE INVENTION

1. Field of the Invention

The present invention relates to an antenna device communicating with radio tags, a radio tag reader and an article management system. In particular, the present invention relates to an antenna device which is able, for example, to collectively read tag information from a plurality of closely located radio tags.

2. Related Art

Generally, patch antennas, for example, have been used as antennas for conventional radio tag readers, as disclosed, for example, in JP-A 2005-167416 (Kokai). In the case where a large number of radio tags are present, the radio tag reader described in this literature is adapted to bring these radio tags into alignment with each other and read the tags only through a portion of a radio emission area of an antenna, which portion has a predetermined power density. For example, radio tags are stuck onto envelopes and then the plurality of envelopes are put together in a storage box for bringing into alignment with each other in the storage box. The storage box is then set for the reader, so that the information recorded on the plurality of radio tags can be read by the reader through the portion of the predetermined power density of the antenna provided in the reader.

However, the prior art described in the literature mentioned above has tended to cause interference when a plurality of radio readers are simultaneously in operation, because radio waves are constantly emitted from the antennas of the individual readers. Also, being influenced by the reflected waves, some portions of the radio tags have been prevented from being read, or radio tags that are not required to be read have been read.

SUMMARY OF THE INVENTION

According to an aspect of the present invention, there is provided with an antenna device comprising:

a first antenna element which is either a spiral antenna element or a loop-like antenna element; and a first feed point provided at a first end of the first antenna element, the first end being an outer end of the spiral antenna element or an one end of the loop-like antenna element, wherein a length from an second end of the first antenna element to the first end of the first antenna element along the first antenna element is about one half wavelength of operating frequency, the second end being an inner end of the spiral antenna element or the other end of the loop-like antenna element.

According to an aspect of the present invention, there is provided with a radio tag reader which reads information written in a radio tag, comprising:

an antenna device recited in claim 1; and a reader having a transmitting/receiving unit that transmit/receives a signal to/from the radio tag through the antenna device.

According to an aspect of the present invention, there is provided with an article management system which manages an article on the basis of information written in a radio tag, comprising:

an antenna device recited in claim 1;

a reader having a transmitting/receiving unit that transmit/receives a signal to/from the radio tag through the antenna device; and an article equipped with the radio tag.

DETAILED DESCRIPTION OF THE INVENTION

With reference to the drawings, hereinafter will be described in detail some embodiments of the present invention.

Figure 1:
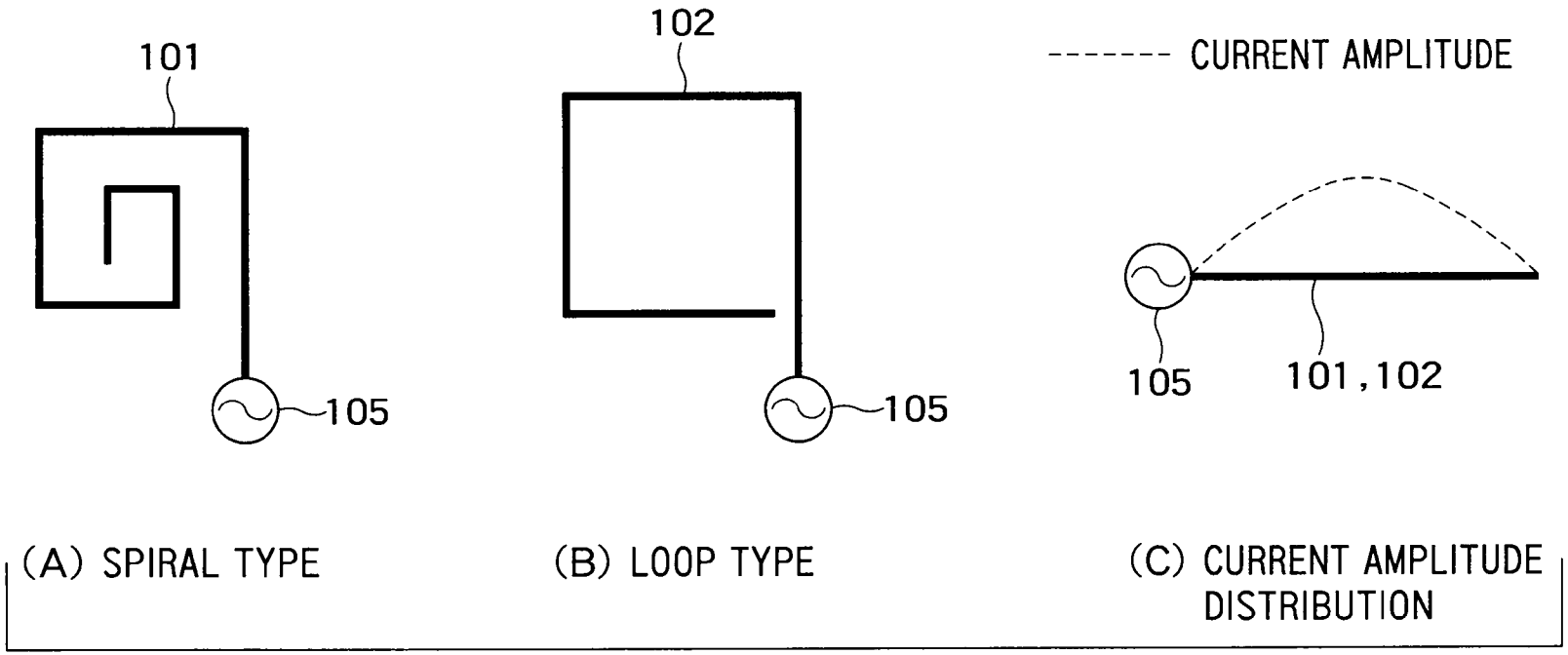
FIG. 1 illustrates antenna devices according to a first embodiment of the present invention.

FIGS. 1(A) and (B) illustrate antenna devices according to a first embodiment of the present invention.

The antenna device illustrated in FIG. 1(A) has: an antenna element (first antenna element) 101 having a wire conductor which is spirally wound with its one end (i.e. an inner end or a second end) being a base point; and a feed point (first feed point) 105 disposed at a position about one half wavelength of the operating frequency from the one end of the antenna element 101. The length of the wire conductor here corresponds to about one half wavelength of the operating frequency, and the feed point 105 is disposed at the other end (i.e. an outer end or a first end) of the spiral-like wire conductor. The example shown in FIG. 1(A) has a wire conductor which is wound into a rectangular shape. This however is only an example. The spiral antenna element may be formed by winding a wire conductor into other shapes, such as a circular shape or a triangular shape.

The antenna device illustrated in FIG. 1(B) has: an antenna element (first antenna element) 102 having a wire conductor which is wound into a loop-like shape with its one end (or a second end) being a base point and a feed point (first feed point) 105 disposed at a position about one half wavelength of the operating frequency from the one end (or a second end) of the antenna element 102. The length of the wire conductor here corresponds to about one half wavelength of the operating frequency, and the feed point 105 is disposed at the other end (or a first end) of the wire conductor. The example shown in FIG. 1(B) has a wire conductor which is wound into a rectangular shape. This however is only an example. The loop-like antenna element may be formed by winding a wire conductor into other shapes, such as circular shape or a triangular shape.

FIG. 1(C) illustrates a current amplitude distribution on the spiral antenna element of FIG. 1(A) or the loop-like antenna element of FIG. 1(B). For clarity, however, FIG. 1(C) shows a state where the spiral or the loop is straightened. As shown, current is passed so that, in the operating frequency, the peak of the current resides in the center of the element having a length of ½ wavelength. Accordingly, the current at the feed point 105 is minimized, while the impedance at the feed point 105 is considerably increased. As a result, current hardly flows into the side of the antenna element from the feed point 105.

Figure 2:
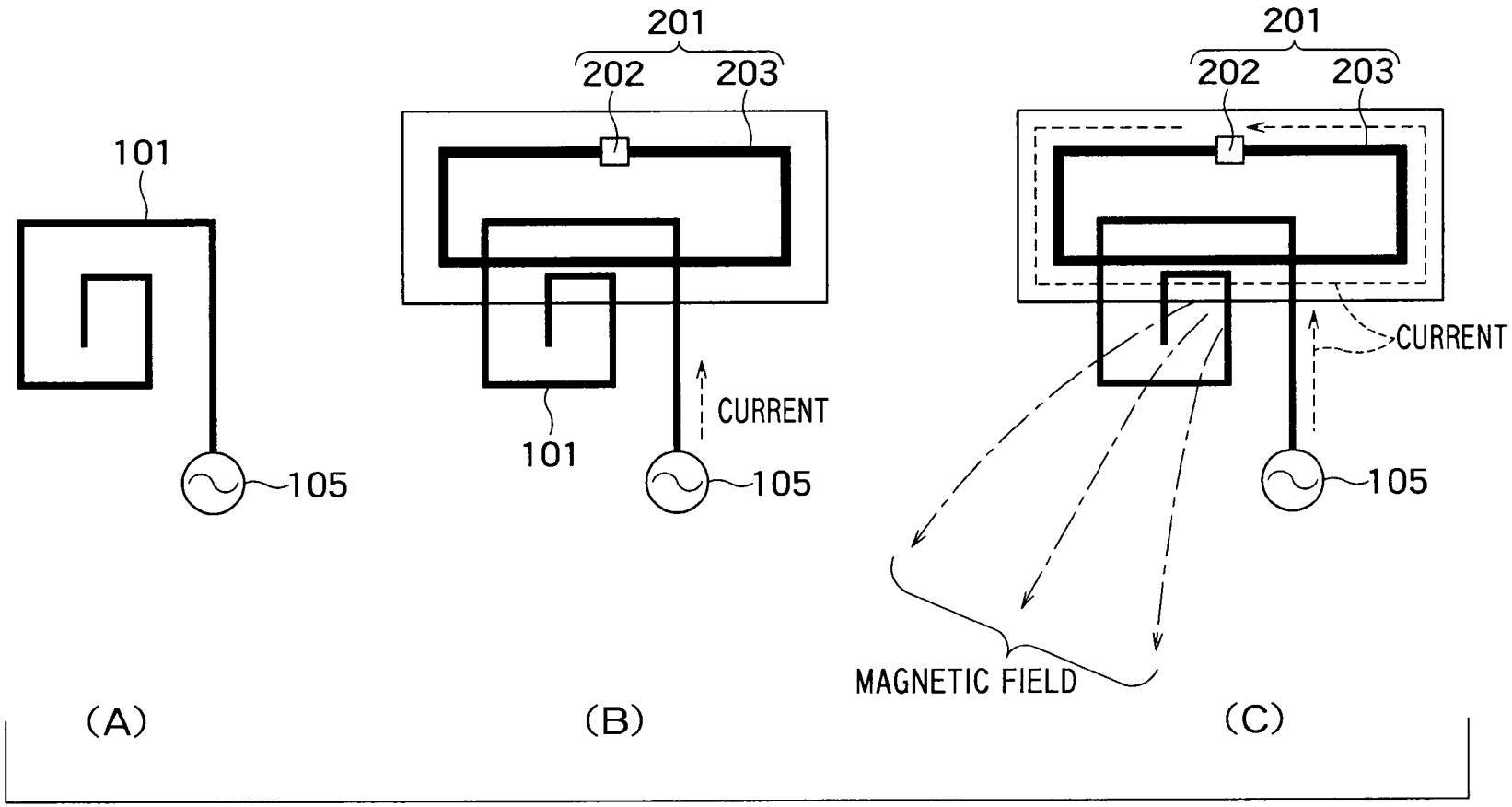
FIG. 2 shows explanatory views illustrating an operation of the antenna devices according to the first embodiment of the present invention.

FIGS. 2(A) to (C) are explanatory views illustrating an operation in the case where the antenna device according to the first embodiment is brought close to a radio tag. The explanation here is given taking an example of a spiral antenna device illustrated in FIG. 1(A). However, the same operation can be obtained as well with the use of a loop-like antenna device.

FIG. 2(A) illustrates a state where the antenna device is not located near a radio tag. As have been explained referring to FIG. 1(C), current hardly flows into the spiral antenna element 101 in this state.

FIG. 2(B) illustrates a state where the antenna device is brought close to a radio tag 201 having an IC chip 202 and a tag antenna 203, so that a plane where the tag antenna 203 resides and a plane where the antenna device resides are parallel to each other. When the antenna device comes close to the radio tag 201, the antenna element 101 and the tag antenna 203 are coupled to allow the impedance of the spiral antenna element 101 to appear as being low from the feed point 105. As a result, current flows into the spiral antenna element 101.

Thus, when current flows into the spiral antenna element 101, a magnetic field is generated, as shown in FIG. 2(C), in a direction perpendicular to the plane of the spiral antenna element 101 (toward this side of the drawing sheet here). This magnetic field causes magnetic field coupling between the spiral antenna element 101 and the tag antenna 203. As a result, current flows on the tag antenna 203 to start the IC chip 202, enabling communication with the radio tag 201. In the figure, the broken-line arrow indicates the current and the dash-dot-line arrows indicate the magnetic field.

As described above, according to the antenna device according to the present embodiment, radio wave is hardly emitted from the antenna element in a non-reading state of a radio tag, while communication is achieved by establishing coupling only with a nearby radio tag in a reading state of a radio tag. Thus, reading can be carried out without causing interference with other radio tag readers.

Also, according to the antenna device according to the present embodiment, information can be read from only desired radio tags in a range which coupling with a reader antenna can cover In this regard, the conventional art has often allowed the radio wave emitted from an antenna to be reflected by a ceiling or floor, for example, which has resultantly allowed reading of an undesired radio tag. For example, in a book vault where a number of shelves are juxtaposed, radio may be reflected to allow reading of a radio tag of a shelf opposed to a target shelf. However, the present invention enables communication with desired radio tags in a range which coupling with the reader antenna can cover, as described above, to prevent such a problem.

In addition, according to the antenna device according to the present embodiment, simultaneous communication can be achieved with a plurality of radio tags to collectively read the information of the plurality of tags.

Figure 3:
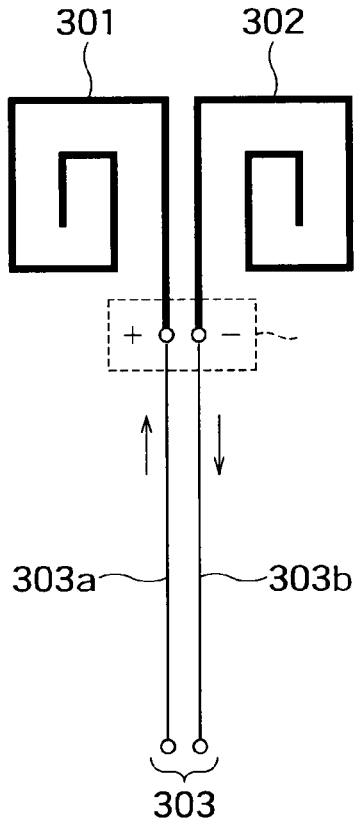
FIG. 3 illustrates an antenna device according to a second embodiment of the present invention.

FIG. 3 illustrates an antenna device according to a second embodiment of the present invention.

Each of one ends of spiral antenna elements 301 and 302 is connected to a differential line (feed line) 303 via a feed portion 304. One of the spiral antenna elements 301 and 302 corresponds to a first antenna element of the present invention and the other one corresponds to a second antenna element of the present invention. The differential line 303 has a plus signal line 303*a* and a minus signal line 303*b*, which transmit positive- and negative-phase signals, respectively, whose phases are reversed from each others. The feed portion 304 includes a first feed point corresponding to a joint between the antenna element 301 and the plus signal line 303*a*, and a second feed point corresponding to a joint between the antenna element 302 and the minus signal line 303*b*. In other words, one end of the plus signal line 303*a* is connected to the one end of the antenna element 301 via the first feed point, and one end of the minus signal line 303*b* is connected to the one end of the antenna element 302 via the second feed point. In the figure, each of the arrows indicates one example of a direction of the current. The plus signal line 303*a* corresponds, for example, to a first signal line, and the minus signal line 303*b* corresponds to a second signal line, or vice versa. A radio frequency module (RF module), for example, for processing high-frequency differential signals is connected to the other end of the plus signal line 303*a* and the other end of the minus signal line 303*b*.

The antenna elements 301 and 302 are formed on same plane each other, one of the antenna elements 301 and 302 being wound in a opposite direction from that of the other element. The antenna elements 301 and 302 are substantially line symmetrically arranged, with the feed portion 304 being substantially positioned on a center line of the line symmetry. Alternatively, the antenna elements 301 and 302 are arranged in a substantially line symmetrical manner with the first or second signal line being used as axis of symmetry. The arrangement of the oppositely-wound and line-symmetrical antenna elements 301 and 302 can uniform the directions and the magnitudes of the magnetic fields generated by the antenna elements, enabling efficient communication with radio tags.

Figure 4:
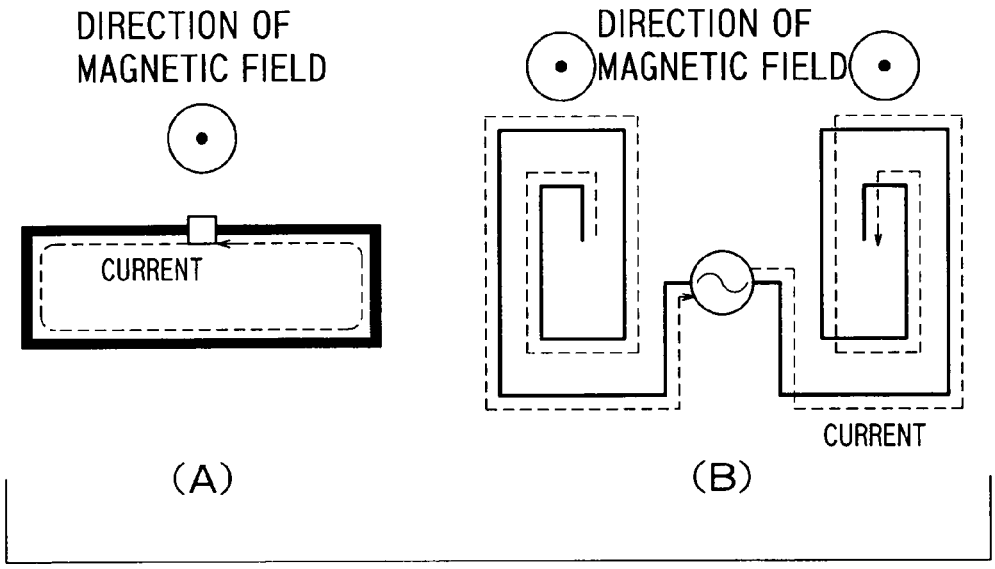
FIG. 4 shows explanatory views illustrating directions of current and magnetic field of an antenna element.

Specifically, FIG. 4(B) illustrates the directions of the current and the magnetic field of each of the antenna elements under operation. As shown, by winding the two antenna elements each other in the opposite directions (the winding directions of the antenna elements here are opposite from those shown in FIG. 3), the directions of the magnetic fields generated by the antenna elements are uniformed. Thus, in a state of reading a radio tag, the direction of the magnetic field generated by each of the antenna elements coincides with the direction of the magnetic field generated by the tag antenna, as shown in FIG. 4(A), whereby efficient communication can be achieved. Further, the substantially line-symmetrical arrangement of the antenna elements can make it easy to uniform the magnitudes of the antenna elements to thereby enable more efficient communication.

Figure 5:
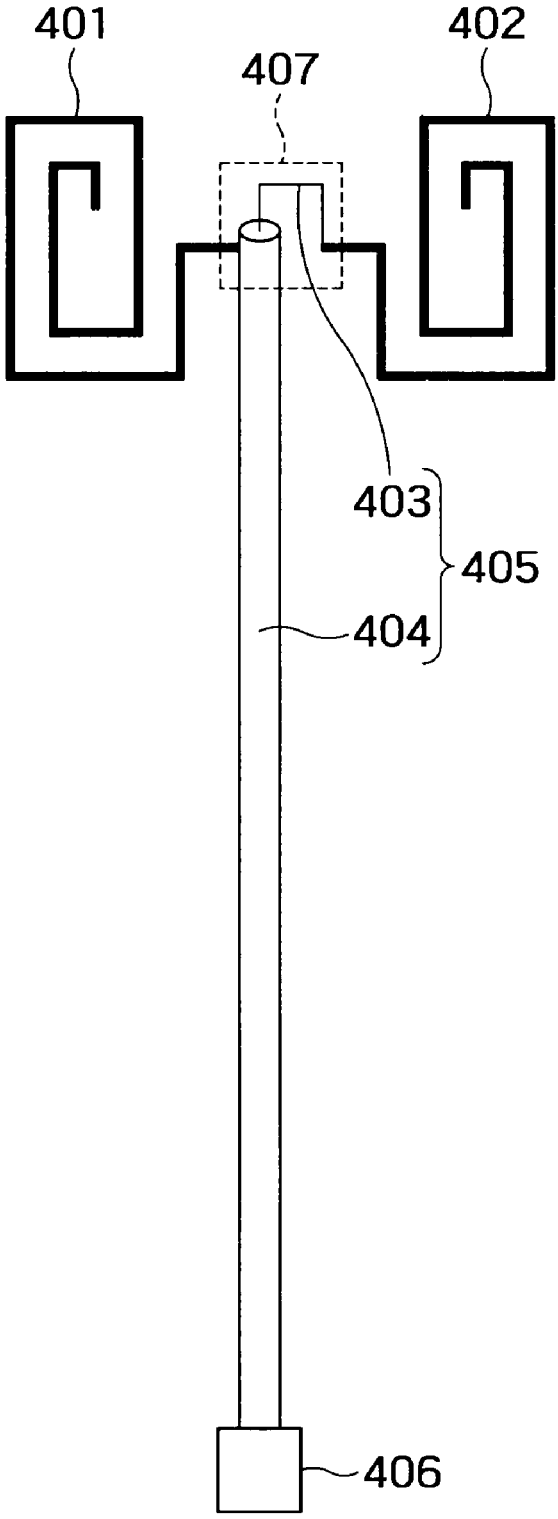
FIG. 5 illustrates an antenna device according to a third embodiment of the present invention.

FIG. 5 illustrates an antenna device according to a third embodiment of the present invention.

One ends of spiral antenna elements 401 and 402 are connected, respectively, to an outer conductor 404 of a coaxial line and an inner conductor 403 led from the coaxial line (feed line) 405, via a feed portion 407. The feed portion 407 includes a first feed point corresponding to a joint between the antenna element 401 and the coaxial line 405 (the outer conductor 404 here), and a second feed point corresponding to a joint between the antenna element 402 and the coaxial line 405 (the inner conductor 403 here). A connector 406 connects the coaxial line 405 to a RF module. The coaxial line 405 has a first signal line and a second signal line for transmitting positive- and negative-phase signals, respectively, whose phases are reversed from each other. The first signal line corresponds, for example, to the outer conductor 404, and the second signal line corresponds to the inner conductor 403, or vice versa.

Similar to the antenna device illustrated in FIG. 3, the antenna elements 401 and 402 are formed on same plane each other, one of the antenna elements 401 and 402 being wound in a opposite direction from that of the other antenna element. The antenna elements 401 and 402 are substantially line symmetrically arranged, with the feed portion 407 being provided on a center line of the line symmetry. Alternatively, the antenna elements 401 and 402 are arranged in a substantially line symmetrical manner with the first or second signal line being used as axis of symmetry.

When operated, magnetic fields of approximately the same magnitude are generated in the same direction from the spiral antenna elements 401 and 402. This allows both of the antenna elements to make communication with the radio tags, thereby enabling efficient communication.

Figure 6:
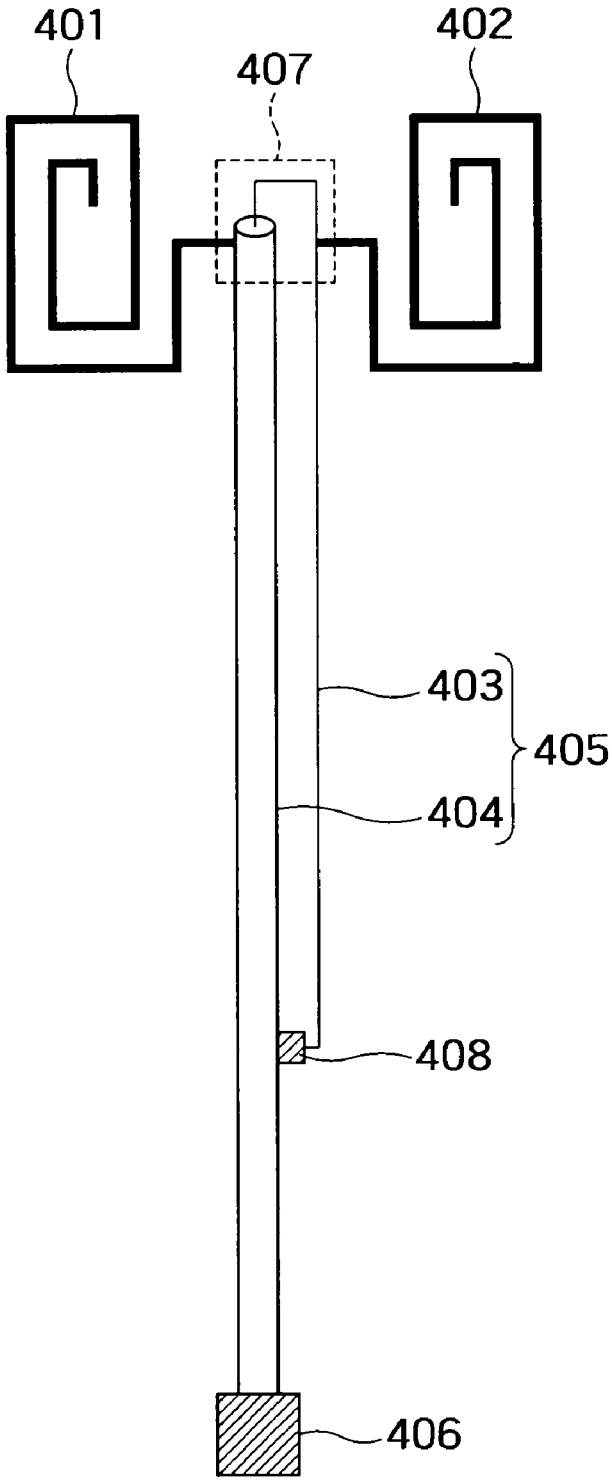
FIG. 6 illustrates a modification of the antenna device illustrated in FIG. 5.

FIG. 6 illustrates a modification of the antenna device illustrated in FIG. 5.

The inner conductor 403 led from the coaxial line 405 is allowed to return by about a quarter-wavelength from the feed point, with its end being connected to the outer conductor 404. Thus, a function of a balun can be imparted to the antenna device by connecting the inner conductor 403 to the outer conductor 404, with the former being permitted to return by about a quarter-wavelength.

Further, the returned end is connected to the outer conductor 404 via a resistor element 408 whose impedance value is substantially the same as the characteristic impedance of the feed line. When the antenna device is not coupled to a radio tag, the electrical power is totally reflected by the end of the coaxial line 405 (near the feed portion). The electrical power, however, can be consumed by the resistor element 408, so that the electrical power can be suppressed from being reflected to an R/W (reader/writer) unit to reduce loading on the R/W unit.

Figure 7:
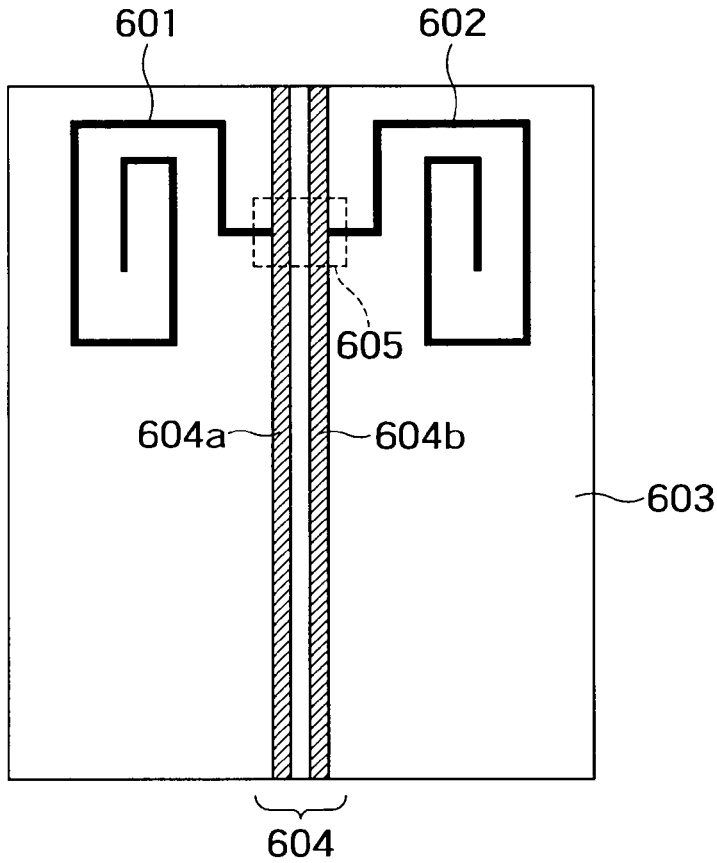
FIG. 7 is a plan view illustrating an antenna device according to a fourth embodiment of the present invention.
Figure 8:
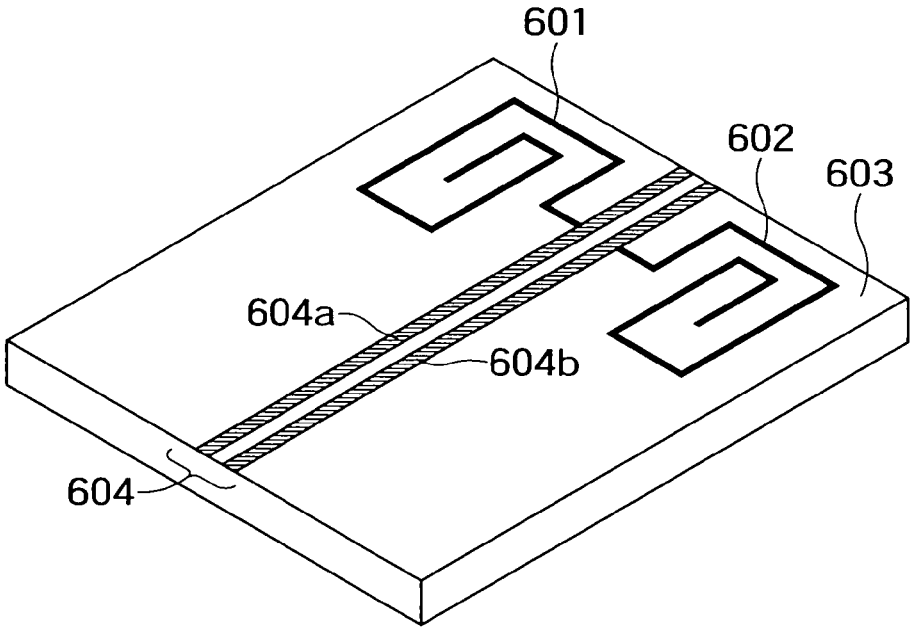
FIG. 8 is a perspective view illustrating the antenna device illustrated in FIG. 7.

FIG. 7 is a plan view illustrating an antenna device according to a fourth embodiment of the present invention. FIG. 8 is a perspective view illustrating the antenna device illustrated in FIG. 7.

A parallel line (feed line) 604 including signal lines 604*a* and 604*b* is formed on a dielectric substrate 603. One ends of spiral antenna elements 601 and 602 are connected to the signal lines 604*a* and 604*b*, respectively, via a feed portion 605. The feed portion 605 includes a first feed point corresponding to a joint between the antenna element 601 and the parallel line 604 (the signal line 604*a* here), and a second feed point corresponding to a joint between the antenna element 602 and the parallel line 604 (the signal line 604*b* here). The parallel line 604 serves as a differential line, with one ends of the signal lines 604*a* and 604*b* (the side opposite to the side where the antenna elements are connected) being connected to respective differential terminals of a radio. Positive- and negative-phase signals, whose phases are reversed from each other, are flowed through the signal lines 604*a* and 604*b*, respectively.

Similar to the antenna device illustrated in FIG. 3, the antenna elements 601 and 602 are formed on same plane each other, one of the antenna elements 601 and 602 being wound in a opposite direction from that of the other antenna element. The antenna elements 601 and 602 are substantially line symmetrically arranged, with the feed portion 605 being provided on a center line of the line symmetry. Alternatively, the antenna elements 601 and 602 are arranged in a substantially line symmetrical manner with the first or second signal line being used as axis of symmetry.

When operated, magnetic fields of approximately the same magnitude are generated in the same direction from the spiral antenna elements 601 and 602. This allows both of the antenna elements to communicate with the radio tags, thereby enabling efficient communication.

Figure 9:
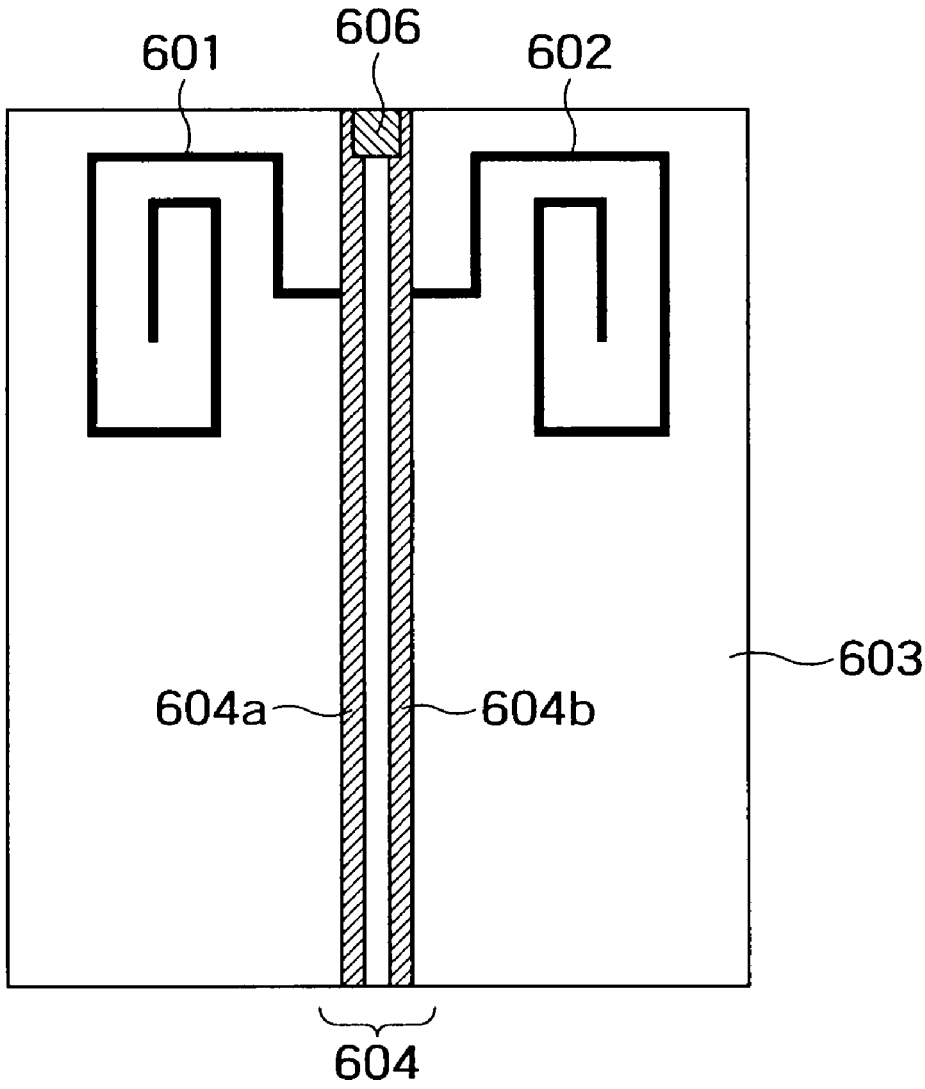
FIG. 9 is a plan view illustrating a modification of the antenna device illustrated in FIG. 7.

FIG. 9 is a plan view illustrating a modification of the antenna device illustrated in FIG. 7.

At an end of the parallel line 604, the signal lines 604*a* and 604*b* are connected via a resistor element 606 whose impedance value is substantially the same as the characteristic impedance of the line 604. When the antenna device is not coupled to a radio tag, the electrical power is totally reflected by the end of the line 604. The electrical power reflected, however, can be consumed by the resistor element 606, so that the electrical power can be suppressed from being reflected to an R/W unit to reduce loading on the R/W unit. In the example illustrated in FIG. 9, the resistor element 606 is provided at one end of the parallel line 604. Alternatively, the resistor element may be arranged at any position between the feed point and the one end of the parallel line. It should be appreciated that the differential terminals of the radio are connected to the other end of the parallel line 604.

Figure 10:
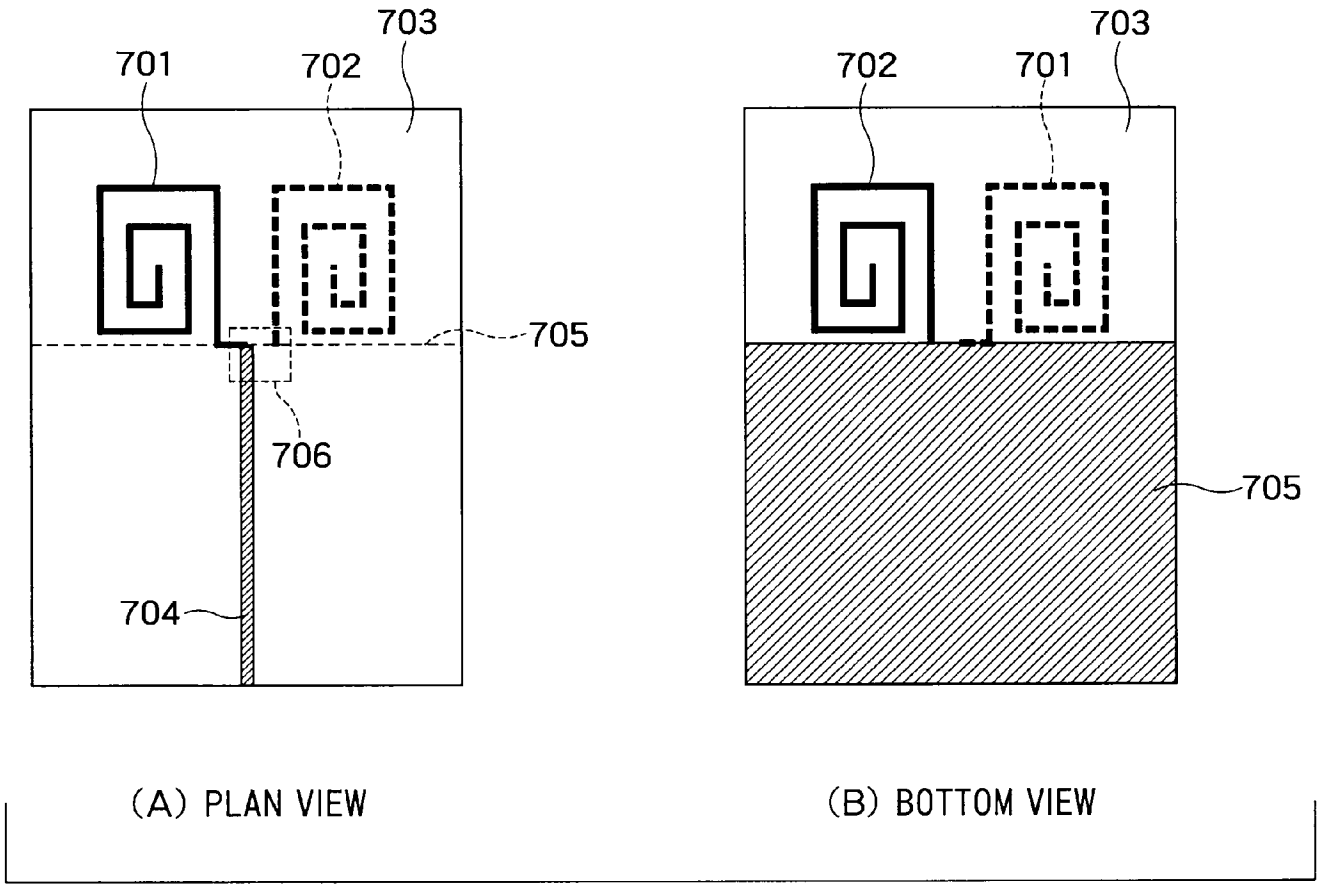
FIG. 10 illustrates an antenna device according to a fifth embodiment of the present invention.
Figure 11:
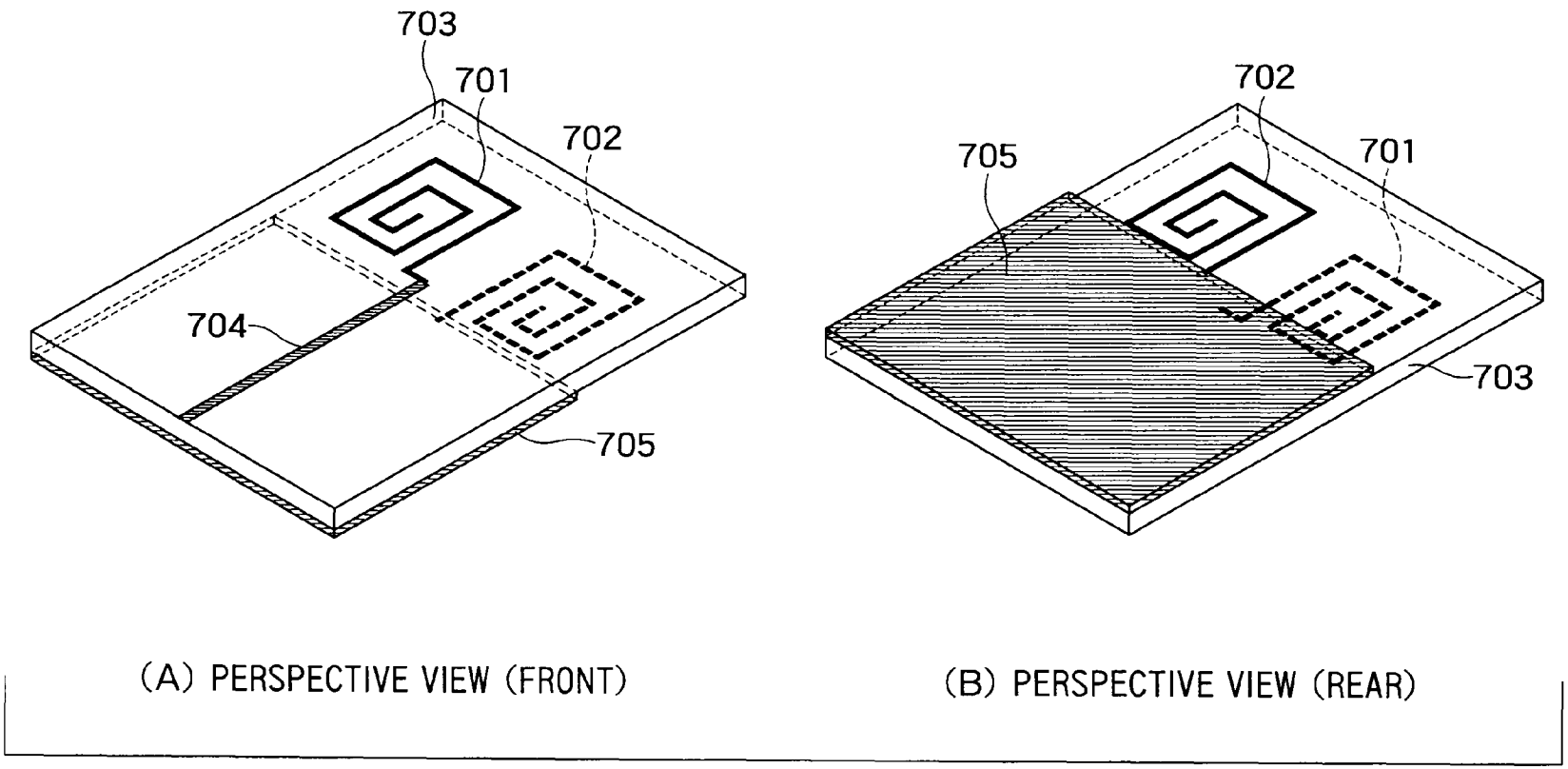
FIG. 11 shows perspective views of the antenna device illustrated in FIG. 10, respectively.

FIGS. 10(A) and (B) illustrate an antenna device according to a fifth embodiment of the present invention. FIG. 10(A) is a plan view and FIG. 10(B) is a bottom view. FIGS. 11(A) and (B) are perspective views of the antenna device illustrated in FIGS. 10(A) and (B), respectively. FIG. 11(A) is an illustration as viewed from a front side, and FIG. 11(B) is an illustration as viewed from a rear side.

In the present embodiment, a feed line is structured by a microstrip line including a ground plane 705, a dielectric substrate 703 and a signal line 704. The microstrip line has a first and second signal lines for transmitting positive- and negative-phase signals, respectively, whose phases are reversed from each other. The first signal line corresponds, for example, to the signal line 704 and the second signal line corresponds to the ground plane 705, or vice versa. The ground plane 705 corresponds, for example, to a ground line. That is, the negative-phase signal propagates the ground plane 705. Here, the ground plane 705 on which the negative-phase propagates may be called as the ground line. Incidentally, the first signal line may correspond to the ground plane 705 and the second signal line may correspond to the signal line 704.

One ends of spiral antenna elements 701 and 702 are arranged on front and rear surfaces, respectively, of the dielectric substrate 703. On the front surface, the one end of the spiral antenna element 701 is connected to the signal line 704. On the rear surface, the one end of the spiral antenna element 702 is connected to the ground plane 705. The ground plane 705 is formed in a part of the region of the rear surface of the dielectric substrate 703, and the antenna element 702 is arranged in the region where no ground plane 705 is formed. Joints between the microstrip line and the antenna elements 701 and 702 correspond, for example, to the feed portion 706 (see FIG. 10(A)). The feed portion 706 includes a first feed point corresponding to the joint between the antenna element 701 and the microstrip line (the signal line 704 here), and a second feed point corresponding to the joint between the antenna element 702 and the microstrip line (the ground plane 705 here).

The antenna elements 701 and 702 in a plan view are wound in the directions opposite from each other. Also, the antenna elements 701 and 702 in a plan view are arranged in a substantially line symmetrical manner, with the feed portion 706 being provided on the center line of the line symmetry. Alternatively, the antenna elements 601 and 602 are arranged in a substantially line symmetrical manner with the first or second signal line being used as axis of symmetry.

When operated, magnetic fields of approximately the same magnitude are generated in the same direction from the spiral antenna elements 701 and 702. This allows both of the antenna elements to make communication with the radio tags, thereby enabling efficient communication.

Figure 12:
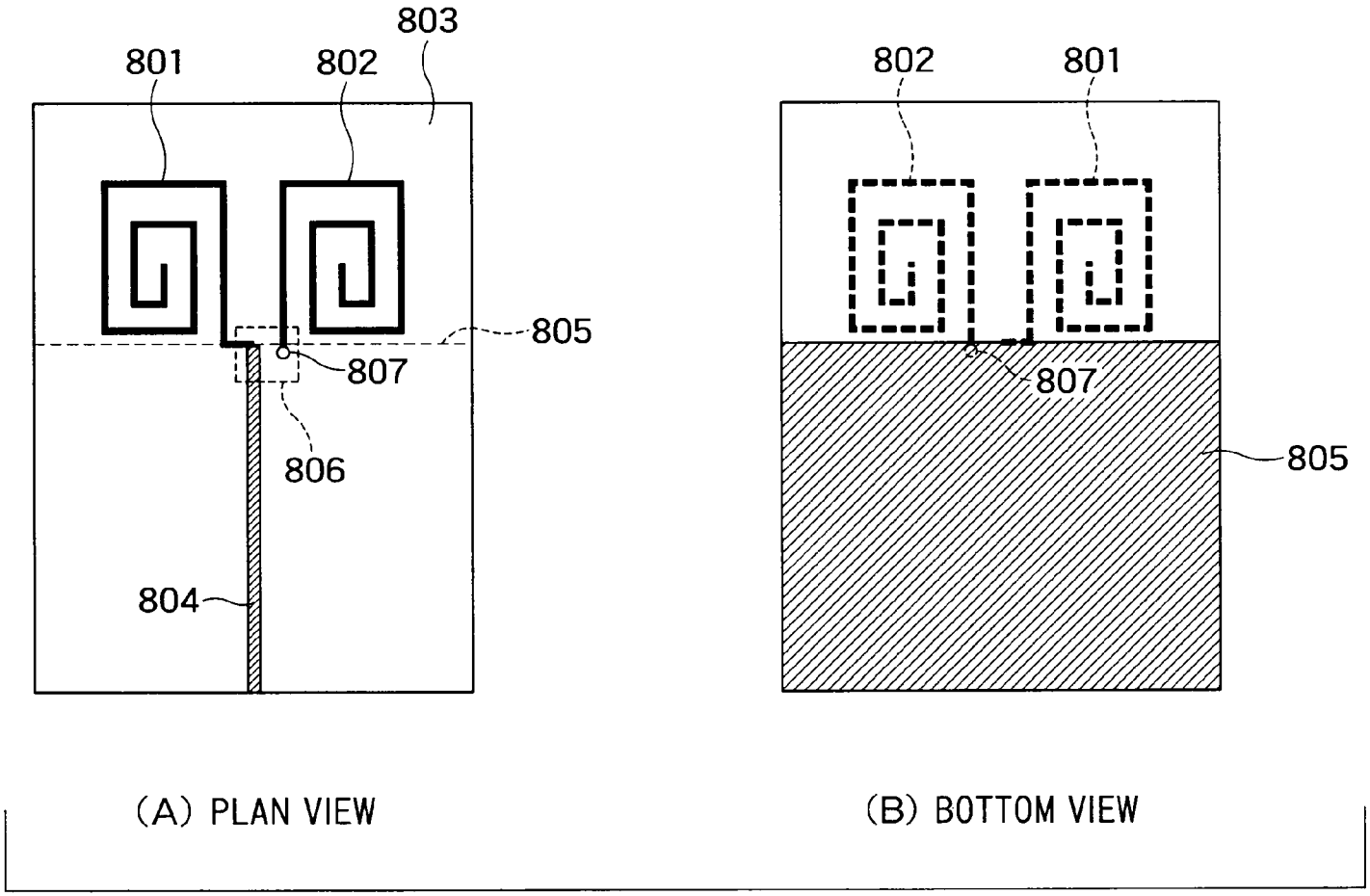
FIG. 12 illustrates an antenna device according to a sixth embodiment of the present invention.
Figure 13:
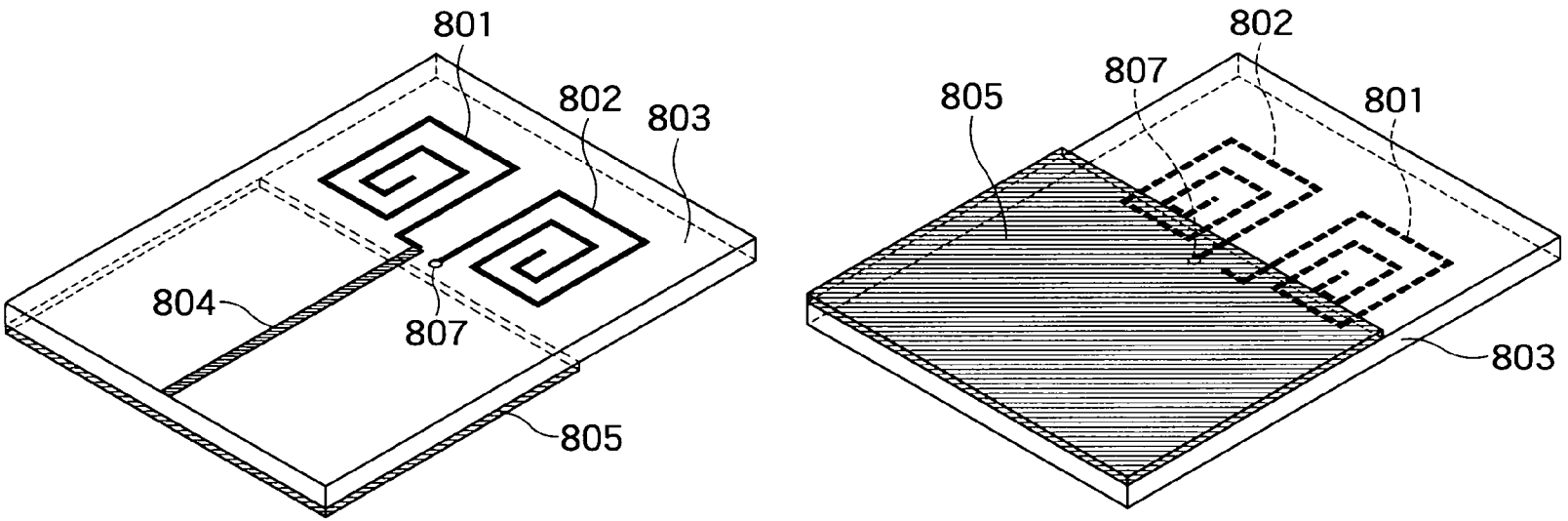
FIG. 13 shows perspective views of the antenna device illustrated in FIG. 12, respectively.

FIGS. 12(A) and (B) illustrate an antenna device according to a sixth embodiment of the present invention. FIG. 12(A) is a plan view and FIG. 12(B) is a bottom view. FIGS. 13(A) and (B) are perspective views of the antenna device illustrated in FIGS. 12(A) and (B), respectively. FIG. 13(A) is an illustration as viewed from the front side, and FIG. 13(B) is an illustration as viewed from the rear side.

The present embodiment is different from the fifth embodiment in that: two spiral antenna elements 801 and 802 are formed on the same plane (front surface) of a dielectric substrate 803; and one antenna element 801 is connected to a signal line 804 and the other antenna element 802 is connected to a ground plane 805 via a through hole 807 formed in the dielectric substrate 803. The remaining structure and the advantages of the present embodiment are the same as those of the fifth embodiment, and thus the detailed description of them is omitted.

FIGS. 14(A) to (D) illustrate examples of generally used radio tags which can communicate with the antenna devices described above. The radio tags illustrated in FIGS. 14(A) to (D) are respectively provided with IC chips 902, 912, 922 and 932, and tag antennas 901, 911, 921 and 931. Each of the broken-line arrows in the figures indicates current.

Radio tags using a low frequency band, such as an HF (high frequency) band, mostly communicate with an antenna of a radio tag reader, using a spiral or loop tag antenna for coupling of inductive fields. On the other hand, radio tags using a UHF (ultra-high frequency) band or a microwave band mostly communicate with an antenna of a tag reader by emitting radio waves, using a dipole antenna or a loop-like antenna as a tag antenna for coupling of radiation fields.

Figure 14:
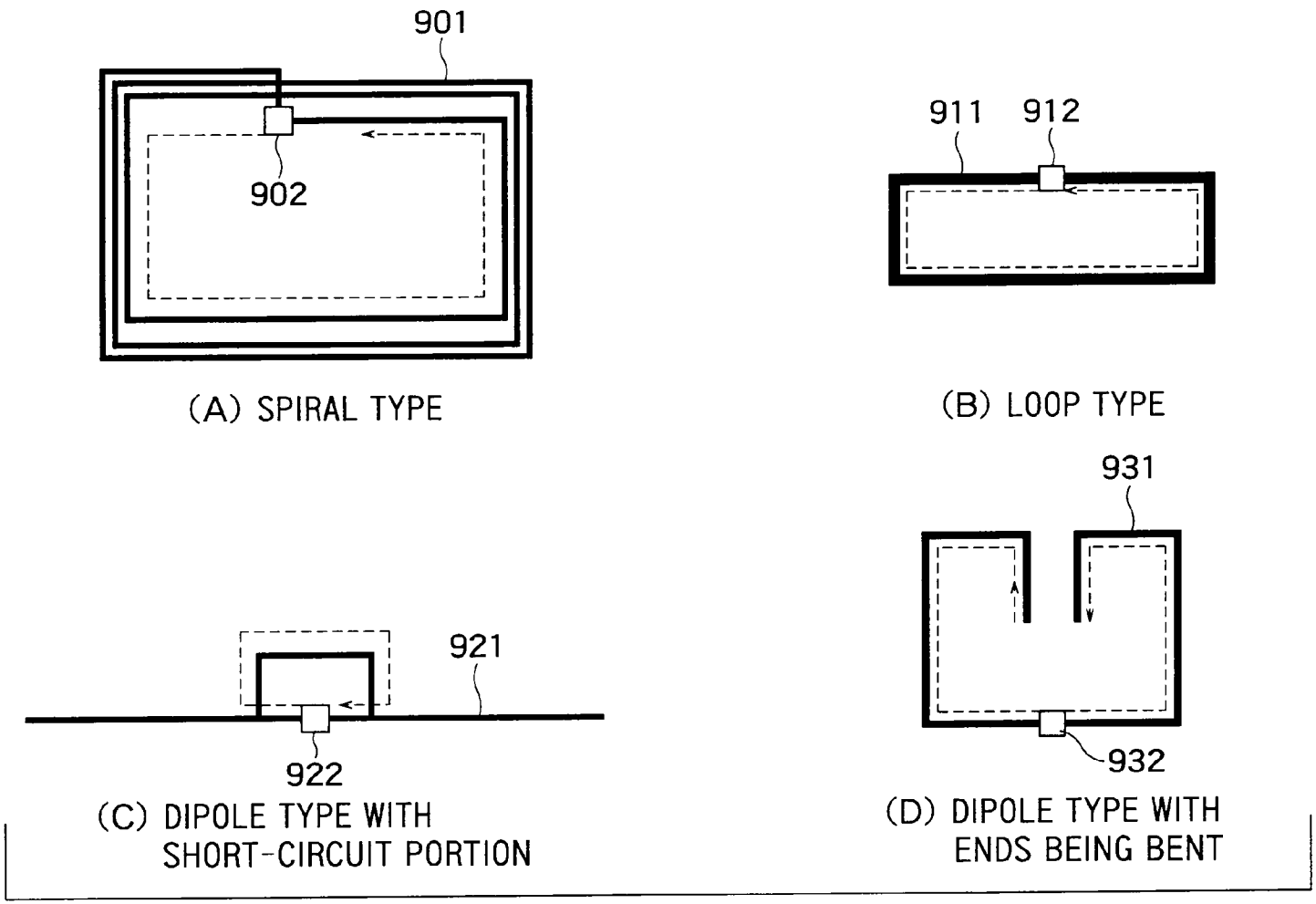
FIG. 14 illustrate examples of generally used radio tags.

In the case where the tag antenna of a radio tag is of a radio emission type like the latter type mentioned above, rather than a magnetic field type like the former type mentioned above, consistency is ensured between the tag antenna and a tag IC having capacitive impedance. For this purpose, it is often the case that such a tag antenna has a looped short-circuit portion as illustrated in FIG. 14(C), or has a ring shape with the ends being bent for downsizing as illustrated in FIG. 14(D). Accordingly, even with the radio tag of the latter type, the antenna device of the present invention can be used to make communication by establishing coupling with a nearby magnetic field.

Figure 15:
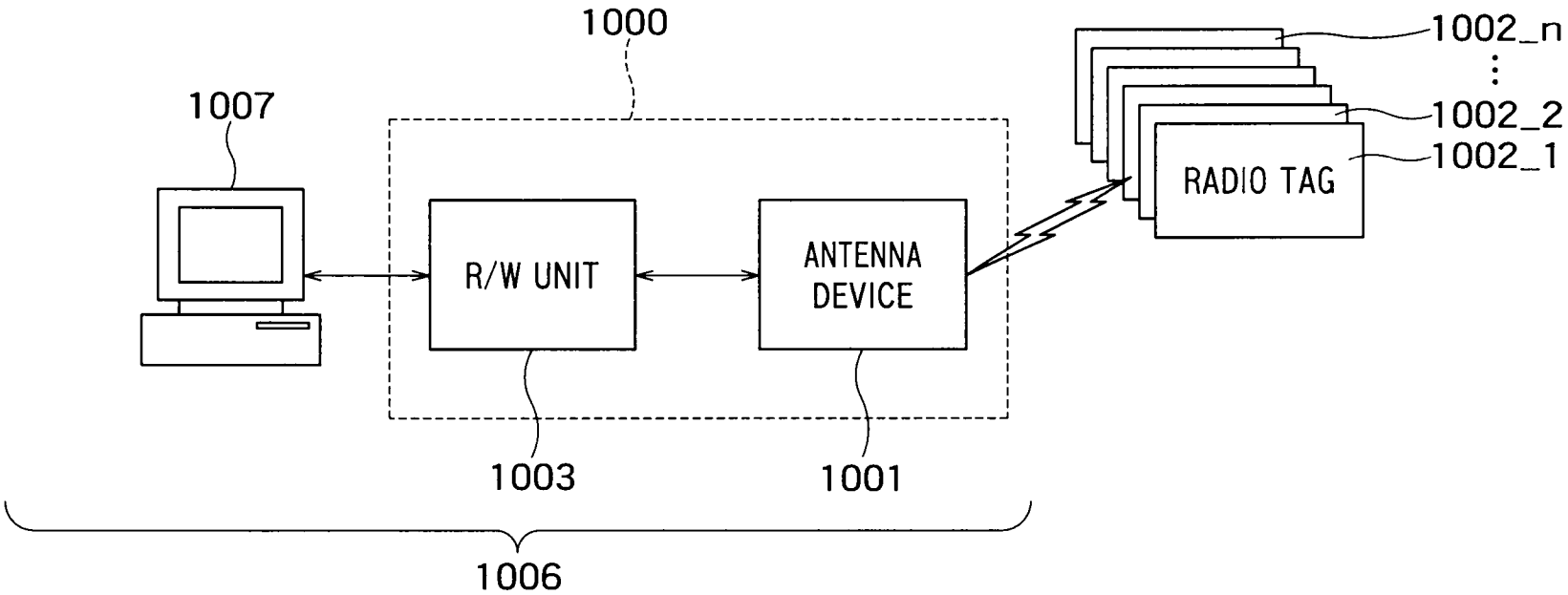
FIG. 15 illustrates a radio tag reader according to an embodiment of the present invention.

FIG. 15 illustrates a radio tag reader according to an embodiment of the present invention.

A radio tag reader 1000 is provided with an antenna device 1001 as an embodiment of the present invention and an R/W unit 1003. The first to sixth embodiments described above or modifications thereof, for example, may be used as the antenna device 1001. The radio tag reader 1000 is connected to a computer (PC: personal computer) 1007 for managing tag information. The radio tag reader 1000 and the PC 1007 constitute a document management unit 1006.

The R/W unit 1003 in the radio tag reader 1000 reads tag information from radio tags 1002_1, 1002_2, . . . and **1002_*n* through the antenna device 1001, outputs the read-out tag information to the PC 1007, and writes tag information received from the PC 1007 into the radio tags 1002_1, 1002_2, . . . and 1002_*n***.

Such a radio tag reader can be applied to a document management system, for example, that is, a system for managing a plurality of articles, to each of which a radio tag is stuck, for example.

Figure 16:
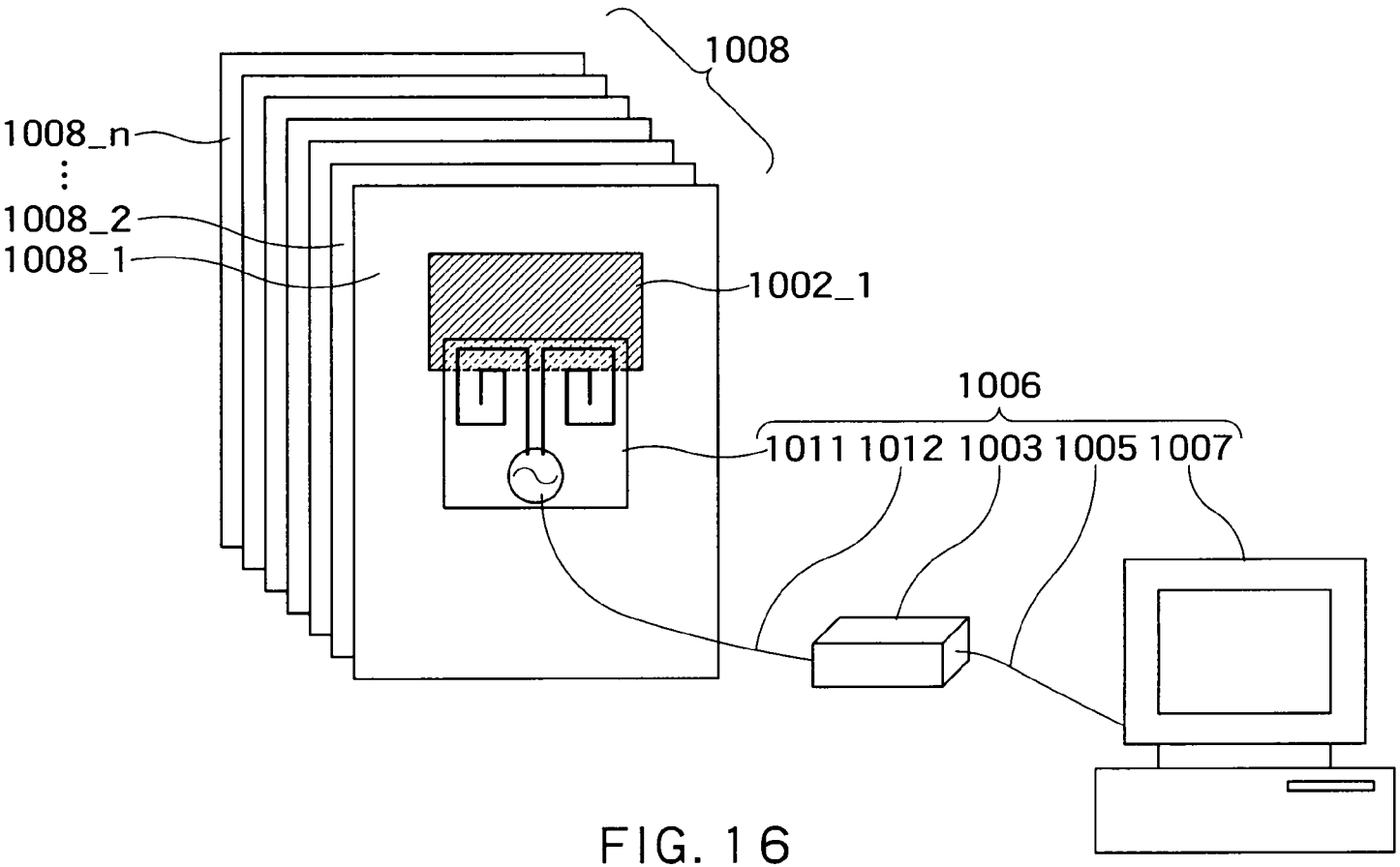
FIG. 16 illustrates an example of an article management system as an embodiment of the present invention.

FIG. 16 illustrates an example of an article management system as an embodiment of the present invention. As an example of such an article management system here, an example of a document management system is shown.

The article management system is provided with: a plurality of documents 1008_1, 1008_2, . . . and **1008_*n* to which radio tags 1002_1, 1002_2, . . . and 1002_*n* are stuck, respectively; and a document management unit 1006 for managing the documents 1008_1, 1008_2, . . . and 1008_*n***.

The document management unit 1006 has the PC 1007, the R/W unit 1003, a cable 1005 connecting between the PC 1007 and the R/W unit 1003, an antenna device 1011 and a feed line 1012. The document management unit 1006 reads and writes information from/into the radio tags 1002_1, 1002_2, . . . and **1002_*n* which are stuck to the plurality of documents 1008_1, 1008_2, . . . and 1008_*n* so as to manage the documents 1008_1, 1008_2, . . . and 1008_*n***.

Document information as tag information, including the ID unique to a radio tag and the title of a document, has been written into each of the radio tags 1002_1, 1002_2, . . . and **1002_*n*. The document management unit 1006 reads out the document information that has been written into the radio tags 1002_1, 1002_2, . . . and 1002_*n*, and manages the documents on the basis of the read-out document information. In the case of adding new documents or rewriting document information, for example, the new document information is written into the radio tags 1002_1, 1002_2, . . . and 1002_*n***.

Figure 17:
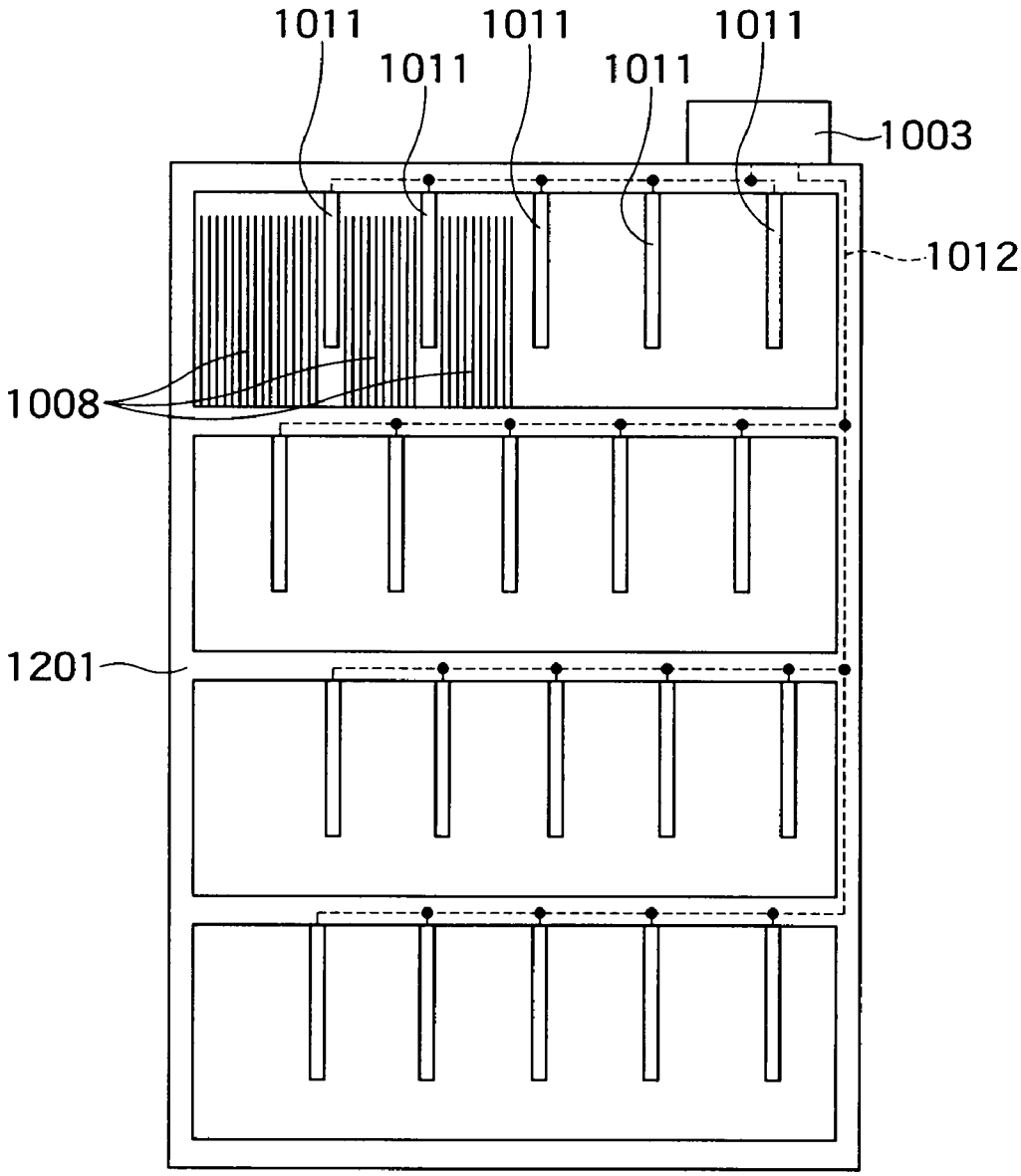
FIG. 17 illustrates another example of a document management system according to the embodiments of the present invention.

FIG. 17 illustrates another example of an article management system (document management system here) according to the embodiments of the present invention.

This document management system is provided to a shelf 1201 accommodating documents. The antenna devices 1011 are provided to respective bookends. Each of the antenna devices 1011 is connected to the R/W unit 1003 provided on top of the shelf, via a feed line 1012 (which is assumed to be a coaxial cable here).

The R/W unit 1003 is connected to a PC (not shown in FIG. 17) that manages the documents, and outputs, via the antenna device 1011, document information to the PC, which document information has been received from each radio tag embedded in each document 1008. The R/W unit is not necessarily set up on top of the shelf but may be set up on a side face or bottom of the shelf, for example.

What is claimed is:

1. An antenna device comprising:

a first antenna element which is either a spiral antenna element or a loop-like antenna element;

a first feed point provided at a first end of the first antenna element, the first end being an outer end of the spiral antenna element or an one end of the loop-like antenna element, a second antenna element which is either a spiral antenna element or a loop-like antenna element;

a second feed point provided at a first end of the second antenna element, the first end of the second antenna element being an outer end of the spiral second antenna element or an one end of the loop-like second antenna element;

a feed line connected to the first antenna element via the first feed point:

the feed line being a differential line including a first signal line and a second signal line which transmit positive- and negative-phase signals, respectively, whose phases are reversed from each other, the first signal line being connected to the first antenna element via the first feed point, and the second signal line being connected to the second antenna element via the second feed point, the first signal line being a plus signal line and the second signal line being a minus signal line, or vice versa, a dielectric substrate; and a resistor element;

wherein a length from an second end of the first antenna element to the first end of the first antenna element along the first antenna element is about one half wavelength of operating frequency, the second end being an inner end of the spiral antenna element or the other end of the loop-like antenna element, the differential line is a parallel line formed on the dielectric substrate, the first and second signal lines have a straight line shape, respectively, the first antenna element is connected midway of the first signal line via the first feed point, the second antenna element is connected midway of the second signal line via the second feed point, and the resistor element connects the first and second signal lines included in the parallel line each other so as to connect a portion of the first signal line from one end of the first signal line to the first feed point and a portion of the second signal line from one end of the second line directed to same direction as the one end of the first signal line to the second feed point.

2. The device according to claim 1, wherein the first antenna element is formed in same plane as the second antenna element, and the first antenna element is wound in an opposite direction from the second antenna element in a planar view.

3. The device according to claim 1, wherein the first antenna element and the second antenna element are arranged in a substantially line symmetrical manner when the first or the second signal line being used as axis of symmetry.

4. A radio tag reader which reads information written in a radio tag, comprising:

the antenna device recited in claim 1; and a reader having a transmitting/receiving unit that transmits/receives a signal to/from the radio tag through the antenna device.

5. An article management system which manages an article on the basis of information written in a radio tag, comprising:

the antenna device recited in claim 1;

a reader having a transmitting/receiving unit that transmits/receives a signal to/from the radio tag through the antenna device; and the article equipped with the radio tag.

6. An antenna device comprising:

a first antenna element which is either a spiral antenna element or a loop-like antenna element;

a first feed point provided at a first end of the first antenna element, the first end being an outer end of the spiral antenna element or an one end of the loop-like antenna element, a second antenna element which is either a spiral antenna element or a loop-like antenna element;

a second feed point provided at a first end of the second antenna element, the first end of the second antenna element being an outer end of the spiral second antenna element or an one end of the loop-like second antenna element;

a feed line connected to the first antenna element via the first feed point, the feed line including a first signal line and a second signal line which transmit positive- and negative-phase signals, respectively, whose phases are reversed from each other; and the first signal line being connected to the first antenna element via the first feed point, and the second signal line being connected to the second antenna element via the second feed point; and a resistor element configured to consume electrical power reflected on at least one of the first and second feed points, wherein a length from an second end of the first antenna element to the first end of the first antenna element along the first antenna element is about one half wavelength of operating frequency, the second end being an inner end of the spiral antenna element or the other end of the loop-like antenna element, the feed line is a coaxial line, the first signal line is an outer conductor and the second signal line is an inner conductor, or vice versa, and the inner conductor of the coaxial line is folded back by about a quarter-wavelength of operating frequency starting from a connecting point with the first feed point or the second feed point, and a folded back end is connected to the outer conductor via the resistor element.

* * * * *